United States Patent [19]

DuBois

[11] Patent Number: 4,702,466

[45] Date of Patent: Oct. 27, 1987

[54] SHEET MATERIAL FEEDER FOR COPIERS AND OTHER SHEET PROCESSING APPARATUS

[76] Inventor: R. Clark DuBois, 332 Wakeman Rd., Fairfield, Conn. 06430

[21] Appl. No.: 698,139

[22] Filed: Feb. 4, 1985

Related U.S. Application Data

[63] Continuation-in-part of Ser. No. 486,757, Apr. 20, 1983, abandoned.

[51] Int. Cl.[4] ..... B65H 7/02

[52] U.S. Cl. ..... 271/10; 271/21; 271/110; 271/117

[58] Field of Search ..... 271/10, 109, 110, 111, 271/117, 170, 265, 272, 273, 274, 269, 21; 221/259

[56] References Cited

U.S. PATENT DOCUMENTS

| | | | |
|---|---|---|---|
| 928,637 | 7/1909 | Davidson | 271/117 |
| 1,570,592 | 1/1926 | Parker | 271/10 |
| 2,571,942 | 10/1951 | Properzi | 271/36 |
| 3,063,711 | 12/1962 | Springer | 271/36 |
| 3,110,490 | 11/1963 | Limberger | 271/117 |
| 3,153,535 | 10/1964 | Gericke | 271/62 |
| 3,231,264 | 1/1966 | Oleinik | 271/11 |
| 3,246,891 | 4/1966 | Mestre | 271/61 |
| 3,325,164 | 6/1967 | Kedzierski | 271/21 |
| 3,476,381 | 11/1969 | Carlson | 271/117 |
| 3,525,517 | 8/1970 | Toby | 271/36 |
| 3,556,516 | 1/1971 | Jones et al. | 271/36 |
| 3,575,410 | 4/1971 | Suzuki | 271/41 |
| 3,588,094 | 11/1962 | Bost | 271/36 |
| 3,588,106 | 6/1971 | Csaba | 271/61 |
| 3,640,524 | 2/1972 | Fredrickson | 271/36 |
| 3,885,783 | 5/1975 | Anderson | 271/34 |
| 3,940,125 | 2/1976 | Morton | 271/10 |
| 4,171,129 | 10/1979 | Daley et al. | 271/6 |
| 4,181,078 | 1/1980 | Davis | 101/426 |
| 4,192,498 | 3/1980 | Toto | 271/21 |
| 4,211,398 | 7/1980 | Bishop | 271/9 |
| 4,319,341 | 3/1982 | Okamoto | 271/118 |
| 4,332,375 | 6/1982 | Tsubo | 271/9 |
| 4,372,547 | 2/1983 | Yanagawa et al. | 271/10 |

FOREIGN PATENT DOCUMENTS

| | | | |
|---|---|---|---|
| 547389 | 8/1956 | Italy | 271/36 |

*Primary Examiner*—Richard A. Schacher

[57] ABSTRACT

A large capacity tray sheet feeder for a photocopier including a sheet stack separator and a transfer table for presenting a sheet to the photocopier where the sheet separator separates a sheet from a paper stack and the transfer table accepts the sheet and presents the sheet to the photocopier, and the transfer table includes sheet sensing means which control the operation of the separator drive motor.

15 Claims, 11 Drawing Figures

SHEET MATERIAL FEEDER FOR COPIERS AND OTHER SHEET PROCESSING APPARATUS

RELATED APPLICATIONS

This application is a continuation-in-part of application Ser. No. 486,757 filed Apr. 20, 1983, now abandoned.

FIELD OF THE INVENTION

This invention relates to photocopiers and more particularly relates to large capacity sheet trays and feed mechanisms therefor for use in conjunction with photocopiers.

BACKGROUND OF THE INVENTION

Photocopiers, at the present time, generally have one or two paper trays which hold different size sheets of paper for feeding sheets into the copying machine. These trays have to be frequently refilled because their capacity is generally no more than 200 or 250 sheets. The existing trays are designed to fit on a holding mechanism on the photocopier and present a stack of paper sheets to a feed roller of the photocopier. Since the photocopier is designed to receive a paper tray or cassette of a given size, it is not possible to merely use a large depth paper tray to hold a greater number of sheets of paper. This presents a drawback where high volume copying is desired in that frequently copying must be halted to reload paper in the tray.

Where a large capacity paper tray is utilized which does not directly couple to the photocopier as shown in the aforementioned co-pending application, a transfer mechanism must be provided to transfer the paper sheets from a stack to the feed roller of the photocopier.

Accordingly, the present invention provides a new and improved large capacity paper tray for a photocopier, including a sheet separator and a transfer mechanism which accepts a separated sheet from the stack and accurately positions the sheet for acceptance by the feed roll of the copier.

SUMMARY OF THE INVENTION

Briefly stated, the invention in one form thereof comprises a tray or housing member having spaced apart opposed side walls adjoined by an end wall to define a receptacle or tray for a sheet stack, a sheet separator and feeder, and a transfer table, which receives a sheet from the separator and positions it accurately to the copier.

The sheet separator moves vertically in the receptacle and includes at least one feed roller and a feed roller drive means including a motor mounted thereto. Also arranged at either end of the separator are pivotally mounted corner separators which rest on leading edges of the sheet stack. The sheet separator will feed one sheet at a time to the transfer table.

The transfer table has a set of driven rollers and a set of idler rollers to prevent skewing of the paper. The transfer table comprises upper and lower guide members to receive a sheet therebetween. The transfer table is pivoted to the tray or housing adjacent the end attached to the copier and is biased toward an upward position.

The separator engages an arm which extends from the transfer table and will pivot the transfer table downwardly as the sheet stack is expended. In this way, the transfer table is always aligned to receive the top sheet of a sheet stack. The biasing force on the transfer table is selected in accordance with the weight of the separator so that the proper frictional engagement of the feed rollers of the separator is always maintained.

Paper sensing means are included in the transfer table and if no sheet of paper is sensed in the transfer table, the motor of the separator will be energized to separate and feed a sheet to the transfer table. The feed rollers on the transfer table are driven to position the paper to the feed roller of the photocopier. Thus there will always be a sheet presented to the photocopier, per se.

An object of this invention is to provide a new and improved large capacity tray for a photocopier, together with a feed mechanism which will accurately position a sheet of paper for acceptance by the photocopier.

Another object of this invention is to provide a device of the type described in which a sheet of paper is always accurately supplied to the transfer table.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF PREFERRED EMBODIMENT OF THE INVENTION

Figure 1:
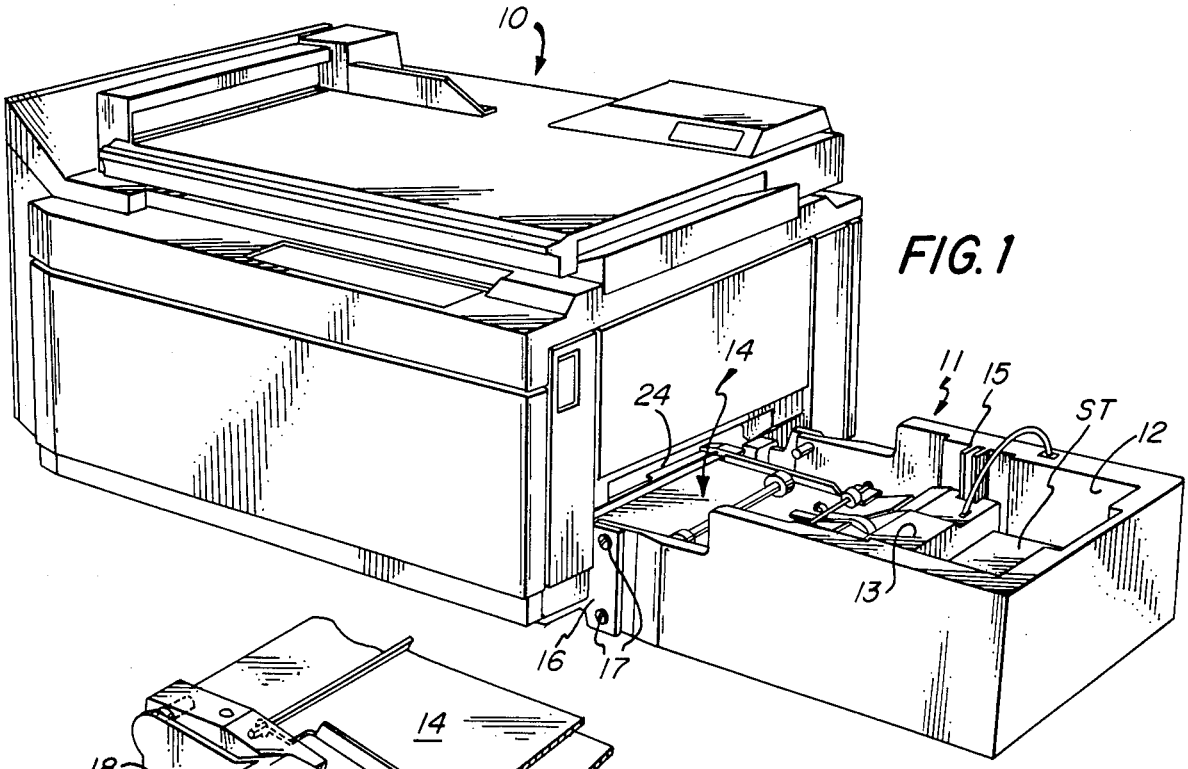
FIG. 1 is an isometric view of a photocopier having a feeding tray embodying the invention.

Referring now to the drawings wherein like reference numerals utilized in the several drawing figures indicate the same objects, there is shown in FIG. 1, a photocopier 10. The particular photocopier 10 is a Ricoh Model No. FT4030. Attached to photocopier 10 is a feed tray generally indicated by the reference numeral 11, which includes a paper storage well 12, a sheet separator mechanism in the form of a vertically movable assembly (hereinafter referred to as separator) 13, and a transfer table 14. Sheet separator 13 is vertically movable under the force of gravity on vertical guides 15. The feed tray 11 has secured thereto at either ends attachment members 16, as by means of fasteners 17.

Figure 2:
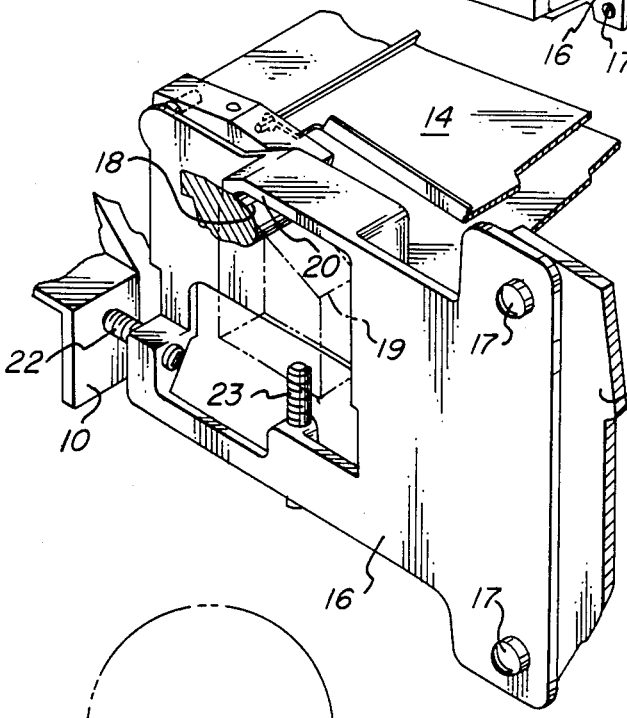
FIG. 2 is a fragmentary view in perspective of the means of attachment of the tray of FIG. 1 to the photocopier.
Figure 3:
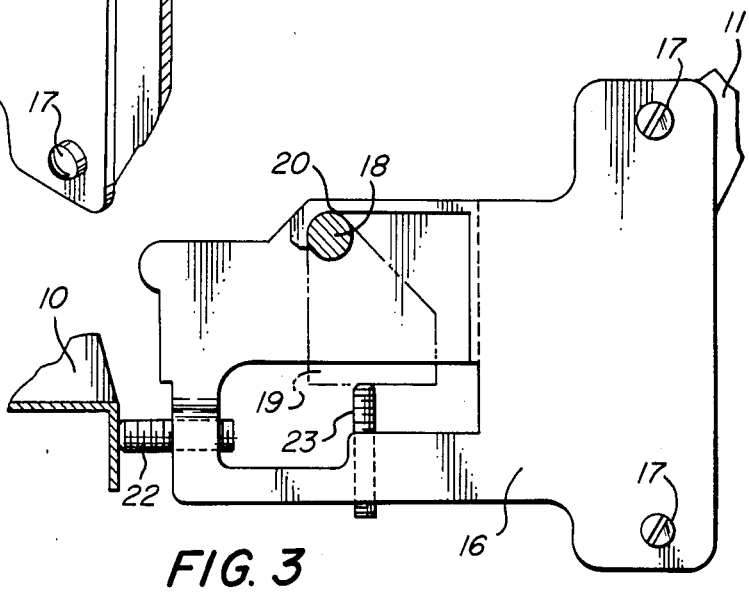
FIG. 3 is a side elevation of attaching mechanism of the tray to the photocopier.

The copier, as shown, includes studs 18 to which the conventional paper tray supplied with the photocopier is attached. As shown in FIGS. 2 and 3, the copier will include a support member 19 for studs 18.

The attachment members 16 are provided with a gripping portion 20 adapted to fit over the studs 18 to provide the primary cantilever support for the tray on the copier.

The attachment members 16 further have on either side thereof set screws 22 and 23 threaded therein. Set screw 22 is set to position attachment member 16 and therefore, tray 11, in a horizontal position with respect to the paper entrance 24 to copier 10. Set screws 23 lock the tray onto studs 18 to prevent accidental detachment of the tray from the copier.

The attachment members 16 may take different forms for different photocopiers dependent on the design of the photocopier tray support.

Figure 4:
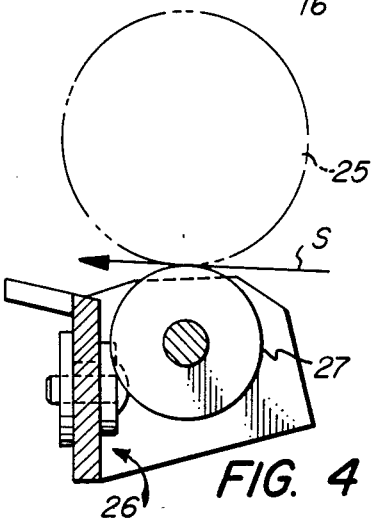
FIG. 4 is a partially schematic side elevation of the feed mechanism of the copier of FIG. 1.

FIG. 4 exemplifies the main feed roller 25 which is a portion of the copier 10 together with a yoke assembly 26 hereinafter described, which gives an attachment or substitution for the feed yoke assembly supplied with the photocopier 10. In FIG. 4, the arrow "S" represents a sheet of paper that has been fed to the feed roller 25 of the photocopier from the tray 11. The yoke assembly 26 includes a bottom idler roller 27.

Figure 5:
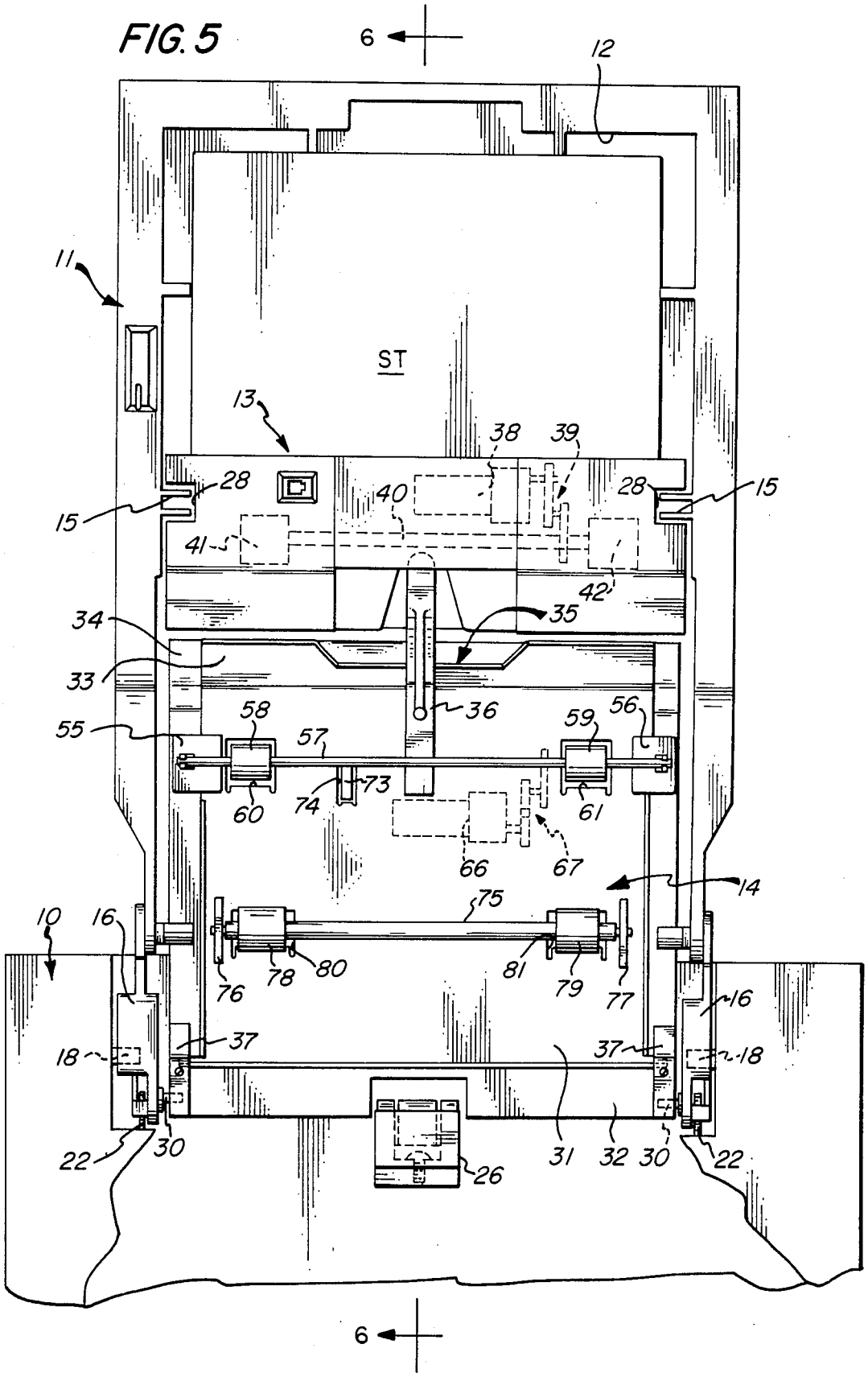
FIG. 5 is a top plan view of the tray of FIG. 1.

Reference is now made to FIG. 5, which is a plan view of the feed tray 11. A stack of sheets "ST" is placed in the stack portion 12 of the tray. The tray includes the guides 15 on either side thereof which are received by mating guideways 28 on either side of the separator 13 so that the separator 13 may ride vertically on the paper stack ST as sheets from the stack are expended to the copier.

Figure 6:
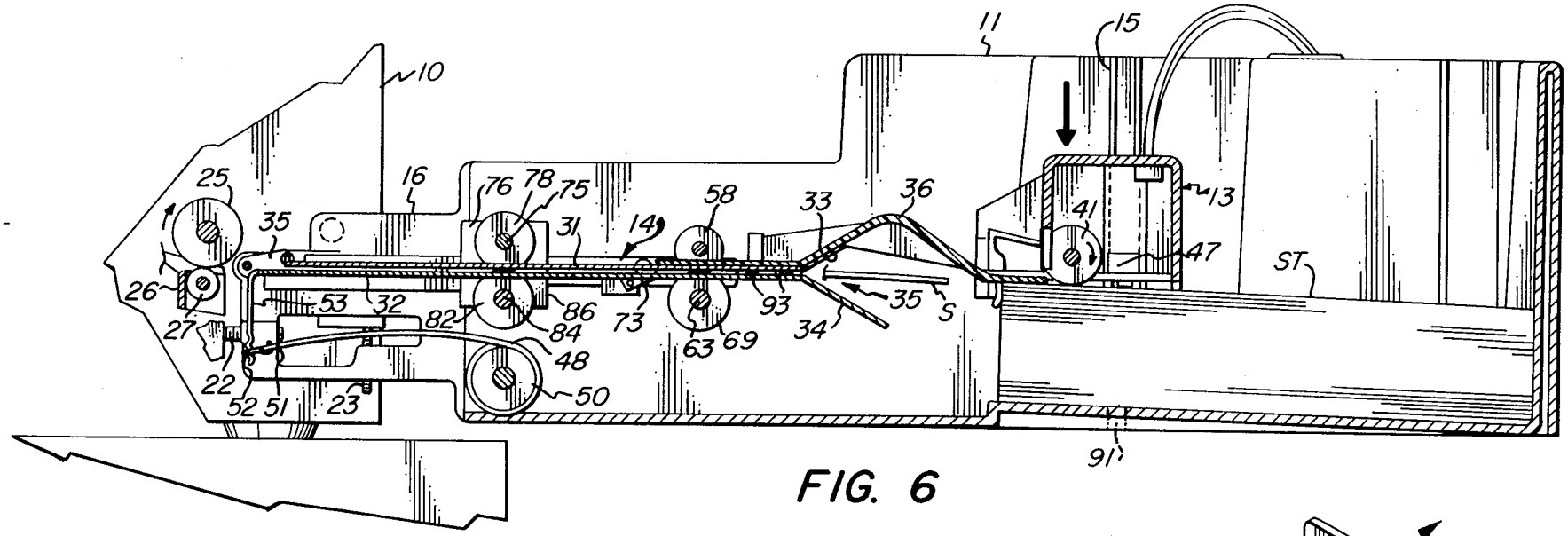
FIG. 6 is a sectional view seen in the plane of lines 6—6 of FIG. 5.
Figure 9:
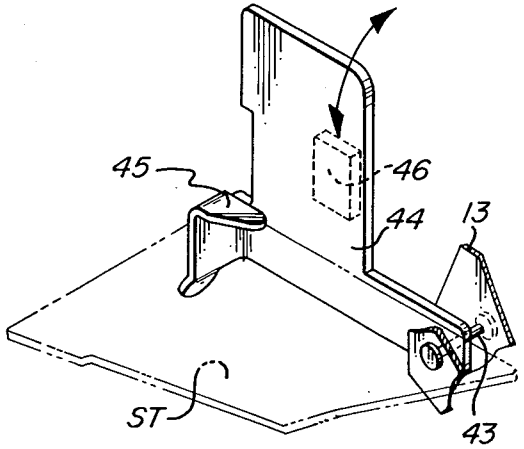
FIG. 9 is a fragmentary view in perspective of a portion of the sheet separator shown in FIGS. 6 and 7.

Transfer table 14 is pivotally mounted to attachment members 16 by means of pins 30 carried by each of attachment members 16. As shown in FIG. 6, transfer table 14 comprises upper and lower guide members 31 and 32, each of which have flared paper receiving ends 33 and 34, respectively, defining a mouth or throat 35 adapted to receive a sheet of paper S from stack ST. Upper guide member 31 is pivotally secured to brackets 37 carried at each end of lower guide member 32. This permits upper guide member 31 to be pivoted upwardly to permit paper to be removed in the event of a jam.

An arm 36 is secured to upper guide member 31 and extends beneath separator 13.

Figure 7:
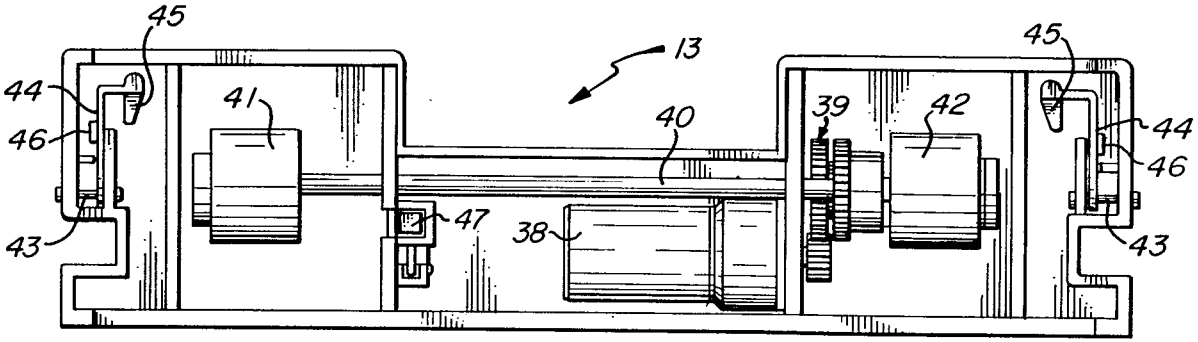
FIG. 7 is a bottom view of a sheet separator feeding mechanism used with the tray of FIG. 1.

Separator 13, as seen from the underside in FIG. 7, includes a drive motor 38 which through a gear train 39 and a one way clutch (not shown) drives a shaft 40 having feed rollers 41 and 42 at opposite ends thereof. The feed rollers 41 and 42 engage a sheet S on stack ST at spaced apart points adjacent to leading edge thereof to feed one sheet S of the stack ST at a time.

Pivotally mounted at each side of separator 13 by means of pins 43 are sheet corner separators 44 including a tang 45 which rest on top of the sheet stack ST. The separator tangs rest on the leading corners of the stack ST and allow only one sheet to be fed at a time. The separators may be weighted by small weights 46 to provide a predetermined pressure on the corner of sheets of a stack ST. The separators have limited pivotal movement away from the stack ST by virtue of the separator housing. The weights 46 are provided to ensure positive contact with the leading corners of the sheet stack ST.

Separator 13 further includes a stack expended switch 47 which is held in a retracted or open position as long as there is a sheet S in stack ST. As hereinafter explained, when stack ST is exhausted, switch 47 will no longer be held in a retracted position and will give a signal indicative of an exhausted paper supply.

Separator 13 will move downwardly on guides 15 under the force of gravity and by virtue of arm 36 transfer table, will move table 14 downwardly therewith, so that the mouth 35 between upper and lower table members 31 and 32 is always positioned to receive a sheet S from stack ST. Arm 36 is configured to guide a sheet S to mouth 35.

Figure 10:
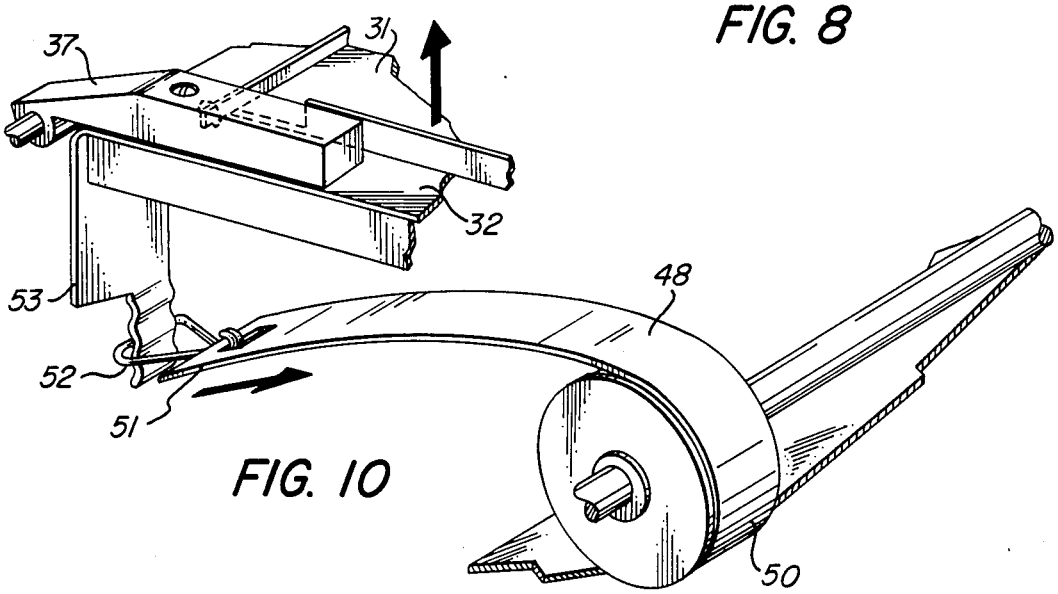
FIG. 10 is a fragmentary view in perspective of a mechanism biasing a transfer table in the tray of FIG. 1.

Transfer table 14 is biased upwardly against the weight of separator 13 by means of a pair of ribbon springs 48 (FIG. 10) on a shaft 49 beneath table 14. Springs 48 have a coiled section 50 and free ends 51 carrying a clip 52 which is hooked to a leg 53 depending from lower guide member 32. Thus, the springs 48 act in a manner to bias the transfer table upwardly at the mouth 35. By virtue of separator 13 resting on arm 36, the weight of separator 13 overcomes the bias of the springs 48 as the stack ST is expended and will maintain transfer table 14 in a position so that mouth 35 thereof will guide a sheet S from stack ST as it is fed off from stack ST by feed bar 13.

Figure 8:
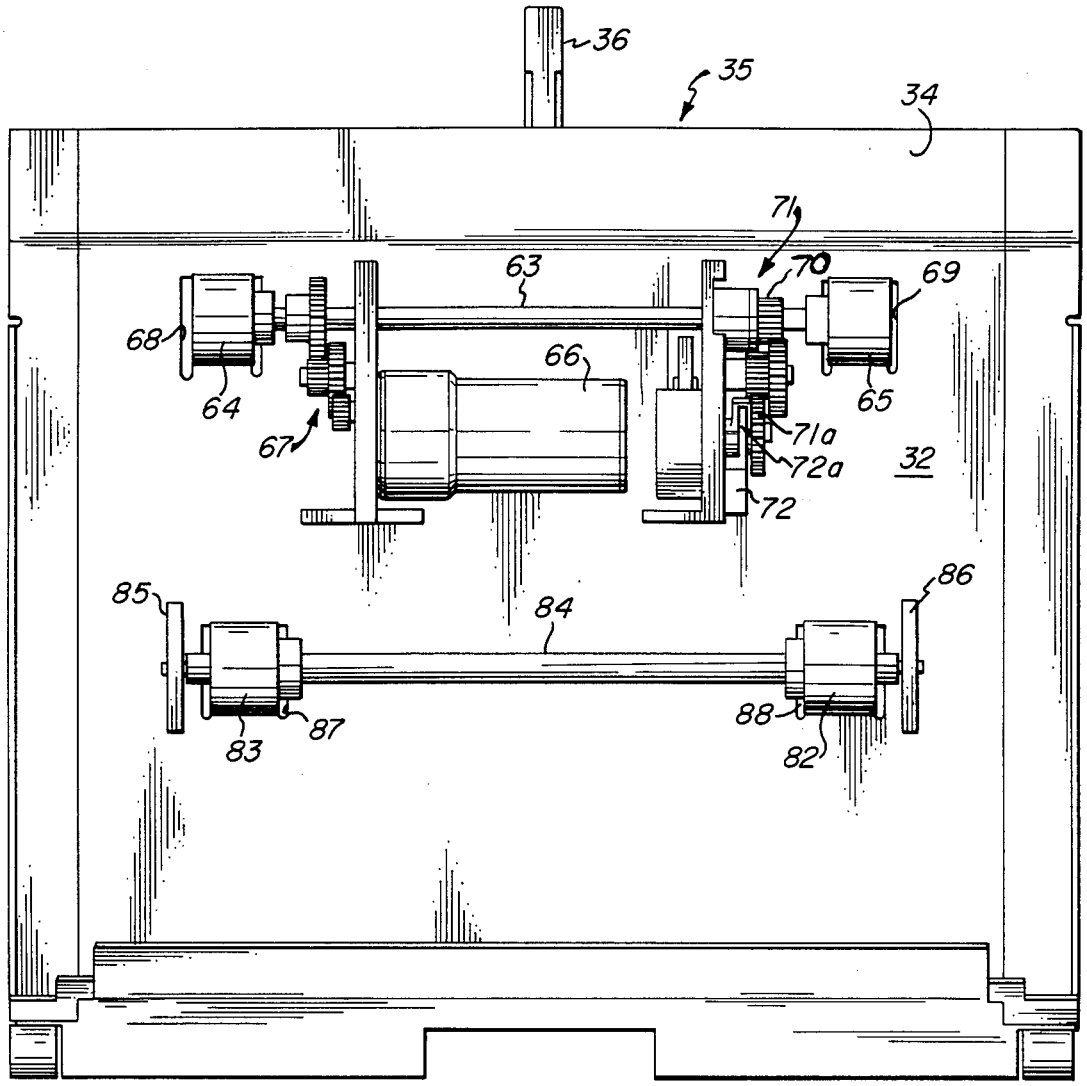
FIG. 8 is a bottom view of the transfer table embodied in the tray of FIG. 1.

Reference is now made to FIGS. 5 and 8 which show the upper and lower sides of transfer table 14, respectively. Referring first to FIG. 5, mounted on upper guide member 31 in brackets 55 and 56 is a shaft 57 carrying idler rolls 58 and 59 which extend through openings 60 and 61, respectively, in guide member 31. The idler rolls 58 and 59 will contact a sheet S being fed from stack ST.

Mounted to the underside of guide member 32, as shown in FIG. 8 in brackets, is a shaft 63 carrying drive feed rollers 64 and 65 which cooperate with idler rollers 59 and 58, respectively. A motor 66 through a gear train 67 and a one way clutch (not shown) drives shaft 63 with rollers 64 and 65 thereon. Openings 68 and 69 are provided in guide member 32 so that the drive rollers 64 and 65 may form a nip with idler rollers 59 and 58. Shaft 63 carries a pinion 70 thereon which drives a gear train 71 which operates a switch 72 by means of a dog **72*a* on a gear to deenergize motor 66 after a predetermined number of revolutions. The number of revolutions is selected such that a sheet S is presented to the nip between photocopier feed roller 25 and idler roller 27 for acceptance by the photocopier. A sheet sensing switch 73 (FIGS. 5 and 6) is carried by lower guide member 32 and extends through an opening therein and an opening 74 in upper guide member 31. Switch 73 is opened when a sheet S is present between guide members 32 and 33 in transfer table 14. When the photocopier feed roller removes a sheet S from transfer table 14, switch 73 will close and cause separator motor 38 to be energized and feed a new sheet S to transfer table 14**, as hereinafter explained.

As shown in FIGS. 5 and 8, a second set of non-driven rollers are provided to prevent any tendency of a sheet S to skew. A shaft 75 is mounted in brackets 76 and 77 carried on upper guide plate 31. Rollers 78 and 79 are mounted to shaft 75 and extend through openings 80 and 81 (FIG. 5), respectively, in guide plate 31 to form nips with rollers 82 and 83 (FIG. 8). Rollers 82 and 83 are carried on a shaft 84 rotatably mounted in brackets 85 and 86 on the underside of lower guide plate 32. Rollers 82 and 83 extend through openings 87 and 88 in lower guide plate 32 to form the nip with rollers 78 and 79 on upper guide plate 31.

As a sheet S is driven by feed rollers 58 and 59, it will enter the nips between rollers 78,82 and 79,83 which will prevent any tendency of a sheet S to skew.

Figure 11:
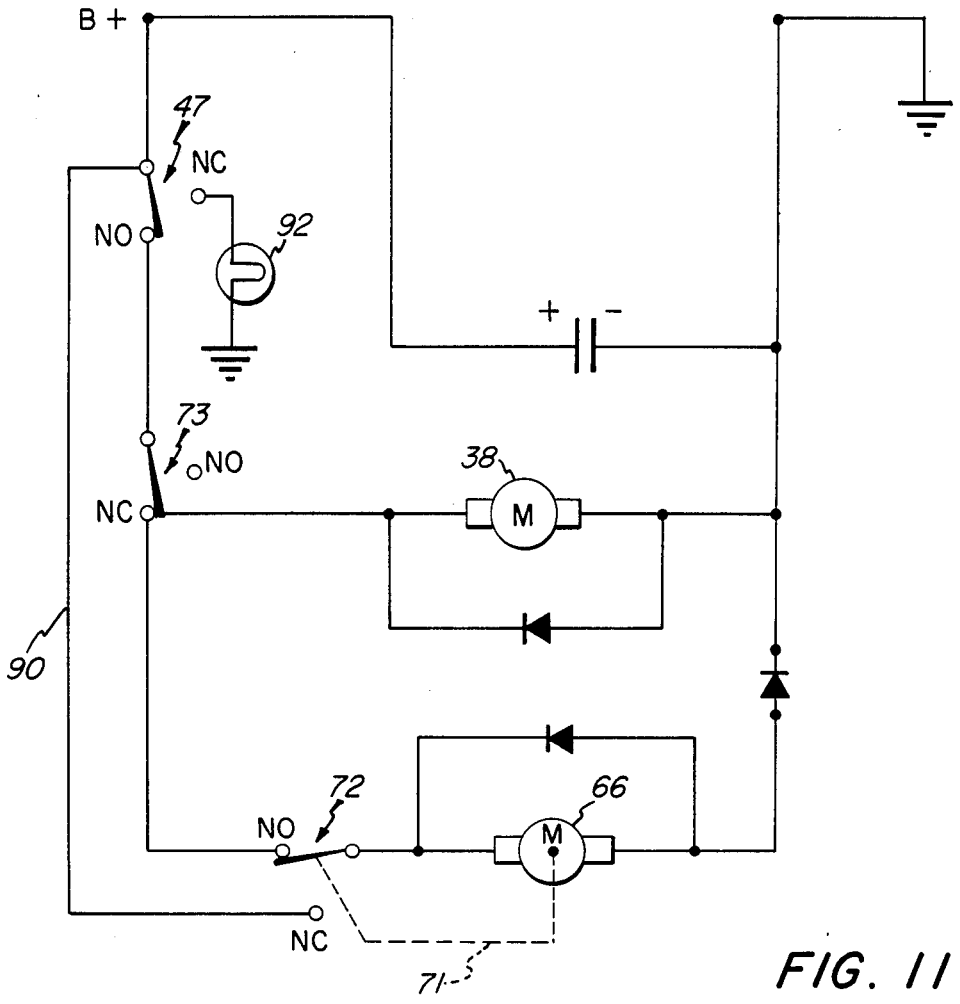
FIG. 11 is a schematic diagram of a circuit controlling the operation of drive motors.

FIG. 11 exemplifies a schematic diagram of a motor control circuit for separator drive motor 38 and transfer table drive motor 73. The operating sequence is as follows: when a sheet S is in transfer table 14, switch 73 is open and separator motor 38 is deenergized, but when the photocopier feed roller 25 takes a sheet S from transfer table 14, switch 73 closes and energizes motor 38. Separator 13 then feeds a sheet S to transfer table 14. As the leading edge of the sheet passes transfer table drive rollers 71 and 72, it will engage and open switch 73, thereby deenergizing separator motor 38. The sheet will then be transferred to a position ready for acceptance by photocopier feed roller 25, at which time switch 72 is opened by arm 72*a* to deenergize motor 66.

In FIG. 11, the switches 47, 72 and 73 are shown as having normally open (NO) and normally closed (NC) contacts. Voltage is applied to separator motor 38 through paper sensing switch 47 and transfer table sheet sensing switch 73. Separator motor 38 will be energized when switch 73 is closed (no sheet in transfer table 14) at the same time motor 66 is energized through the normally closed NC contact of switch 72. As a sheet S moves over switch 73, it is opened and separator motor 38 is deenergized. Then switch 72 is moved to its NO contact by gear 71*a* and motor 66 is deenergized. A sheet S is now presented to the photocopier feed roller 25. When this sheet is fed into the photocopier, switch 73 closes. This in essense is the transfer table calling for the separator to supply another sheet to the transfer table. Switch 72 is a spring biased switch which will return to its normally closed contact unless acted upon by arm 71*a*. Thus, at initial start-up, voltage is applied to motor 66 over line 90, but when switch 72 is moved to its NO contact by gear 71*a*, it will be energized when switch 73 closes. Upon further rotation of gear 71*a*, switch 72 will return to its NC contact.

Switch 47 is biased open but when paper is in tray 12, it is held closed. When the paper supply is exhausted, switch 47 will extend into a recess 91 (FIG. 5) in the bottom of tray 11 and make its NC contact (FIG. 11). This will cause a warning lamp 92 to illuminate, signifying that paper must be added to the tray. The warning lamp 92 may be inherently part of the copier.

The guide member 31 is made pivotal with respect to guide 32 so that it may be easily raised to clear a paper jam. The guide members 31 and 32 are spaced at the non-pivoted ends, and held together by magnets 93 (FIG. 5). This maintains proper pressure on the mating rollers of the transfer table.

As each sheet is fed from the stack ST, the separator 13 moves down incrementally on guides 15 under its own weight providing constant feed drive force perpendicular to the paper. Simultaneously, the separator 13 incrementally pivots transfer table 14 so that mouth 35 is properly positioned to accept a sheet S.

The separator motor, when energized, will run until a separated sheet is sensed by switch 73 which moves to its NO Contact, the separated sheet S will not be clear of rollers 41 and 42 when motor 38 is deenergized. However, the one way clutch in the drive will permit free wheeling of shaft 40 and rollers 41 and 42, and transfer table drive rollers 64 and 65 will pull the sheet onto the transfer table into a position for acceptance by copier feed roller 25.

When the stack ST is exhausted, the separator 13 is removed from receptacle 12, a new supply of paper is inserted into receptacle 12, separator 13 is replaced on guides 15, and the sheet feeder is again ready for use.

It may thus be seen that the objects of the invention set forth, as well as those made apparent from the foregoing description, are efficiently attained. While preferred embodiments of the invention have been set forth for purposes of disclosure; however, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A paper sheet feeder for a copier having sheet receiving means including a feed roller, comprising a member defining a receptacle for a sheet stack, said member having vertically extending linear guide means, a sheet separator assembly for removing the top sheet from a sheet stack in said receptacle, said separator assembly including second guide means thereon mating with said vertical guide means so that said separator assembly may move vertically on said sheet stack as said sheet stack is depleted, at least one feed roller rotatably mounted on said separator assembly and positioned to engage the top sheet of a stack, feed roller drive means including a motor on said separator assembly, paper corner separators mounted to said separator assembly and arranged to engage the leading corners of a sheet stack whereby said separator assembly is supported on the sheet stack through said at least one feed roller, said sheet feeder including a transfer table between said sheet feeder assembly and the copier, said transfer table having upper and lower drive means for accepting a sheet from the stack and delivering an accepted sheet to the copier, sheet sensing means on said transfer table, said sheet sensing means being effective to energize said separator assembly motor to feed a sheet to said transfer table if no sheet is sensed on said transfer table and to de-energize said separator motor when a sheet is sensed on said transfer table.

2. The sheet feeder of claim 1 wherein said edge corner separators are pivotally mounted to said sheet separator assembly.

3. The sheet feeder of claim 2 where said corner separators are weighted toward engagement with the leading corners of the sheet stack.

4. The sheet feeder of claim 1 where said transfer table is pivotally mounted to said sheet feeder at the end thereof adapted to be mounted to the copier, said transfer table comprising upper and lower guide means arranged to receive a sheet from separator assembly and deliver it to the copier, said upper and lower drive means extending through said guide means to engage a sheet therebetween, means biasing said transfer table upwardly, said separator assembly overlying a portion of said transfer table whereby the weight of said separator assembly pivots said transfer downwardly as the sheets of the stack are depleted.

5. The sheet feeder of claim 4 further including said receptacle has means for attachment to said copier, a transfer table pivotally mounted to said tray at the end thereof adapted to be attached to the photocopier, said table comprising upper and lower guide members arranged to receive a sheet from said separator assembly and deliver it to the copier, driven feed rollers on said transfer table, means biasing said transfer table upwardly, said separator assembly overlying a portion of said transfer table whereby the weight of said separator assembly pivots said transfer table downwardly as the sheets of the stack are expended, and said upper guide member is pivotally mounted to said lower guide member adjacent the end of said tray adapted to be attached to the photocopier.

6. The sheet feeder of claim 5 where said upper and lower guide members have flared ends defining a mouth adapted to receive a sheet from said separator assembly.

7. The sheet feeder of claim 4 further including said receptacle has means for attachment to said copier, a transfer table pivotally mounted to said tray at the end thereof adapted to be attached to the photocopier, said table comprising upper and lower guide members arranged to receive a sheet from said separator assembly and deliver it to the copier, driven feed rollers on said transfer table, means biasing said transfer table upwardly, said separator assembly overlying a portion of said transfer table whereby the weight of said separator assembly pivots said transfer table downwardly as the sheets of the stack are expended, and means cooperating with said driven feed rollers on said transfer table for positioning a sheet on said transfer table for acceptance by the feed roller of the copiers.

8. The sheet feeder of claim 7 where said upper and lower drive means comprises drive rollers and said cooperating means comprises means for limiting the number of revolutions of said driver rollers.

9. The sheet feeder of claim 7 where said transfer table includes an arm which extends under said separator assembly.

10. A paper sheet feeder for a copier having sheet receiving means including a feed roller, comprising a tray member defining a receptacle for a sheet stack, said tray member having vertically extending linear guide means thereon, a sheet separator assembly for removing the top sheet from a sheet stack in said receptacle, said separator assembly including second guide means thereon mating with said vertical guide means so that said separator assembly may move vertically on said sheet stack as said sheet stack is expended, said separator assembly including at least one feed roller rotatably mounted on said separator assembly and positioned to engage the top sheet of a stack and upon rotation thereof move the top sheet from the stack, feed roller drive means including a motor fixedly mounted on said separator assembly, said tray member having means for attachment to said copier, a transfer table pivotally mounted to said tray at the end thereof adapted to be attached to the photocopier, said transfer table comprising upper and lower guide members arranged to receive a sheet from said separator assembly and deliver it to the copier, driven feed rollers on said transfer table, means biasing said transfer table upwardly, said separator assembly overlying a portion of said transfer table whereby the weight of said separator assembly pivots said transfer table downwardly as the sheets of the stack are expended, and sheet sensing means on said transfer table, said sensing means being effective to energize said separator assembly motor to feed a sheet to said transfer table if no sheet is sensed in said transfer table and to deenergize said separator motor when a sheet is sensed in said transfer table.

11. The sheet feeder of claim 10 where said transfer table includes an arm which extends under said separator assembly.

12. A paper sheet feeder for a copier having sheet receiving means including a feed roller, comprising a tray member defining a receptacle for a sheet stack, said tray member having vertically extending linear guide means thereon, a sheet separator assembly for removing the top sheet from a sheet stack in said receptacle, said separator assembly including second guide means thereon mating with said vertical guide means so that said separator assembly may move vertically on said sheet stack as said sheet stack is expended, said separator assembly including at least one feed roller rotatably mounted on said separator assembly and positioned to engage the top sheet of a stack, feed roller drive means including a motor fixedly mounted on said separator assembly for operating said at least one roller to remove a sheet from the stack, said tray member having means for attachment to said copier, a transfer table pivotally mounted to said tray member at the end thereof adapted to be attached to the photocopier, said table comprising upper and lower guide members arranged to receive a sheet from said separator and deliver it to the copier, driven feed rollers on said transfer table, means biasing said transfer table upwardly, said separator assembly overlying a portion of said transfer table whereby the weight of said separator assembly pivots said transfer table downwardly as the sheets of the stack are expended, said upper guide member being pivotally mounted to said lower guide member adjacent the end of said tray adapted to be attached to the photocopier.

13. The sheet feeder of claim 12 where said upper and lower guide members have flared ends defining a mouth adapted to receive a sheet from said separator assembly.

14. A paper sheet feeder for a copier having sheet receiving means including a feed roller, comprising a tray member defining a receptacle for a sheet stack, said tray member having vertically extending linear guide means thereon, a separator assembly for removing the top sheet from a sheet stack in said receptacle and including second guide means thereon mating with said vertical guide means so that said separator assembly may move vertically on said sheet stack as said sheet stack is expended, said separator assembly including at least one feed roller rotatably mounted on said separator assembly and positioned to engage the top sheet of a stack, feed roller drive means including a motor fixedly mounted on said separator assembly for operating said feed roller to remove a sheet from the stack, said tray member having means for attachment to said copier, a transfer table pivotally mounted to said tray at the end thereof adapted to be attached to the photocopiers, said table comprising upper and lower guide members arranged to receive a sheet from said separator assembly and deliver it to the copier, driven feed rollers on said transfer table, means biasing said transfer table upwardly, said separator assembly overlying a portion of said transfer table whereby the weight of said separator assembly pivots said transfer table downwardly as the sheets of the stack are expended, said upper guide member being pivotally mounted to said lower guide member adjacent the end of said tray adapted to be attached to the photocopiers, and means cooperating with said driven feed rollers on said transfer table for positioning a sheet on said transfer table for acceptance by the feed roller of said copier.

15. The sheet feeder of claim 14 where said cooperating means comprises means for limiting the number of revolutions of said transfer table feed rollers.

* * * * *